US005227733A

United States Patent [19]

Yamada

[11] Patent Number: 5,227,733

[45] Date of Patent: Jul. 13, 1993

[54] INVERSE COMPTON SCATTERING APPARATUS

[75] Inventor: Hironari Yamada, Tokyo, Japan

[73] Assignee: Sumitomo Heavy Industries, Ltd., Tokyo, Japan

[21] Appl. No.: 668,512

[22] PCT Filed: Jul. 26, 1990

[86] PCT No.: PCT/JP90/00956

§ 371 Date: Mar. 22, 1991

§ 102(e) Date: Mar. 22, 1991

[87] PCT Pub. No.: WO91/02446

PCT Pub. Date: Feb. 21, 1991

[30] Foreign Application Priority Data

Jul. 26, 1989 [JP] Japan ..... 1-191366

[51] Int. Cl.[5] ..... H05H 13/00

[52] U.S. Cl. ..... 328/234; 328/228; 328/235; 378/210

[58] Field of Search ..... 328/227, 234, 228, 233, 328/235; 378/86, 119, 145, 210; 313/62; 372/2

[56] References Cited

U.S. PATENT DOCUMENTS 3,879,679 4/1975 Mourier ..... 328/233
4,598,415 7/1986 Luccio et al. ..... 378/119

FOREIGN PATENT DOCUMENTS 62-229700 10/1987 Japan .
64-72500 3/1989 Japan .

OTHER PUBLICATIONS

Noriyuki Takahashi et al., "Compact SR Light Source for X-Ray Lithography", 1988, pp. 47-54, *Electron Beam, X ray and Ion Beam Technology; Submicrometer Lithographies VII*, SPIE vol. 923.

Hironari Yamada, "Photon Storage Ring", Sep. 1989, pp. L1665-L1668, *Japanese Journal of Applied Physics*, vol. 28, No. 9.

*Primary Examiner*—Donald J. Yusko
*Assistant Examiner*—Michael Horabik
*Attorney, Agent, or Firm*—Frishauf, Holtz, Goodman & Woodward

[57] ABSTRACT

Long-wavelength light is introduced into an electron orbit capable of storing high-speed electrons to produce inverse Compton scattering to scatter short-wavelength light to provide short-wavelength light. The introduced long-wavelength light is repeatedly reflected and repeatedly touches the electron orbit. The effective collision cross section of the introduced light with electrons can be substantially increased by increasing the number of collisions. Sufficiently short-wavelength light can be obtained by a small-sized apparatus without making the electron energy very high.

18 Claims, 5 Drawing Sheets

INVERSE COMPTON SCATTERING APPARATUS

TECHNICAL FIELD

The present invention relates to an inverse Compton scattering apparatus using inverse Compton scattering in which photons are collided with electrons and scattered to be excited into a high-energy state, and more particularly to a radiation apparatus using inverse Compton scattering.

"Light" or "radiation" in this specification means electromagnetic waves having wavelength widely ranging from millimeter to X-rays. "Photon" in this specification means a quantized unit of light.

BACKGROUND ART

In recent years, special attention has been given to a synchrotron radiation (SR) apparatus as a short-wavelength light source for manufacturing semiconductor devices. Electrons accelerated nearly to the light velocity are stored in a predetermined orbit, so that SR lights generated in a tangential direction when electrons are bent in magnetic field or the like are taken out as light output. The SR light is generated with continuous spectra over a wide wavelength range.

The SR apparatus is utilized as an X-ray lithography light source for the manufacture of semiconductor devices and as a monochromatic X-ray source for the structural analysis of a substance, the elemental analysis, the medical and measuring purpose such as an X-ray microscope, etc.

In the SR apparatus, electrons are stored in the electron orbit to thereby generate SR light, but it cannot be said that the strength of the SR light at a desired wavelength is always sufficient. In general, sufficiently short-wavelength light cannot be generated if electrons cannot be accelerated to 1 GeV or more. To this end, generally, the apparats has an electron orbit shaped like a race track, a circle, or the like, with a radius of 10 meters or more. However, if such a large light source is used, the light source becomes too large as a light source for the production of semiconductor devices. Therefore, a smaller-sized short-wavelength light source has been demanded. Various proposals for improving the usefulness of the SR apparatus have been made.

There has ben a proposal in which a light guide for reflecting radiation is provided so as to surround the outer circumference of an electron orbit of an electron storage ring to thereby constitute the Photon Storage Ring. When, for example, the electron orbit is circular, a barrel-like or cylindrical mirror surface which is concave in section encloses the electron orbit. Radiation generated from the electron orbit is reflected on the light guide and stored in the light guide. In this way, an intense radiation can be taken out.

When the electron orbit in the electron storage ring is truly circular and the light guide forms a concentric circle with respect to the electron orbit, monochromatic light can be taken out by interference of lights if the radius of curvature of the light guide is set to a specific value.

A free electron laser can be formed by inducing emission through interactions between electrons and the light stored in the light storage ring.

However, suffering from various restrictions, the wavelength of the light generated by these means cannot be made sufficiently short.

DISCLOSURE OF INVENTION

An object of the present invention is to provide a novel inverse Compton scattering apparatus using inverse Compton scattering.

Another object of the present invention is to provide an inverse Compton scattering apparatus for generating output light having an energy higher than that of introduced light, by using an electron storage ring and by using inverse Compton scattering.

Compton scattering is a phenomenon of elastic scattering of photons and electrons. Both the law of energy conservation and the law of momentum conservations are held in the collision of photons with electrons, so that the wavelength of scattered light depends on the angle of scattering. In inverse Compton scattering, light is scattered in the direction of the traveling direction of electrons, so that the energy thereof increases.

Long-wavelength light is introduced in a direction reverse to that of the movement of electrons from a tangential direction of the electron orbit while electrons are stored in the electron storage ring to thereby make the light collide with the electrons. Being subjected to inverse Compton scattering, the energy of light scattered in the traveling direction of the electrons increases and the wavelength thereof is shortened. The incident light may be given from the outside or may be a component of radiation emitted from the electron storage ring. The scattering cross section in Compton scattering is not so large. Therefore, incident light not scattered by electrons at the first time of collision can be made to collide with electrons again if the incident light is reflected by a reflection means after once making the incident light touch the electron orbit. In the case where the light guide for the Photon Storage Ring light guide is formed in the surroundings of the electron orbit, the light guide can serve as the aforementioned reflection means. In this case, reflection is repeated with no limitation. In this way, the phenomenon in which the scattering cross section is small can be utilized effectively by repeating the chance of scattering.

EMBODIMENTS

It is known that the wavelength of light can be shortened by using inverse Compton scattering in which light is collided with electrons. It has been, however, considered that scattering cross section in inverse Compton scattering is too small to obtain a light source for a practical inverse Compton scattering apparatus.

In the following, the inverse Compton scattering apparatus in the case where the present invention is applied to an SR apparatus will be mainly described, although it has no limitative meaning.

A small-sized SR apparatus developed by the present applicant or assignee has a circular electron orbit with an orbit radius of about 0.5 m. Emission light up to about 10 KeV is generated by the SR apparatus. When the following construction for performing inverse Compton scattering is added to this apparatus, efficiently short-wavelength X rays or $\gamma$ rays can be generated.

Embodiments of the present invention will be described below.

Figure 1:
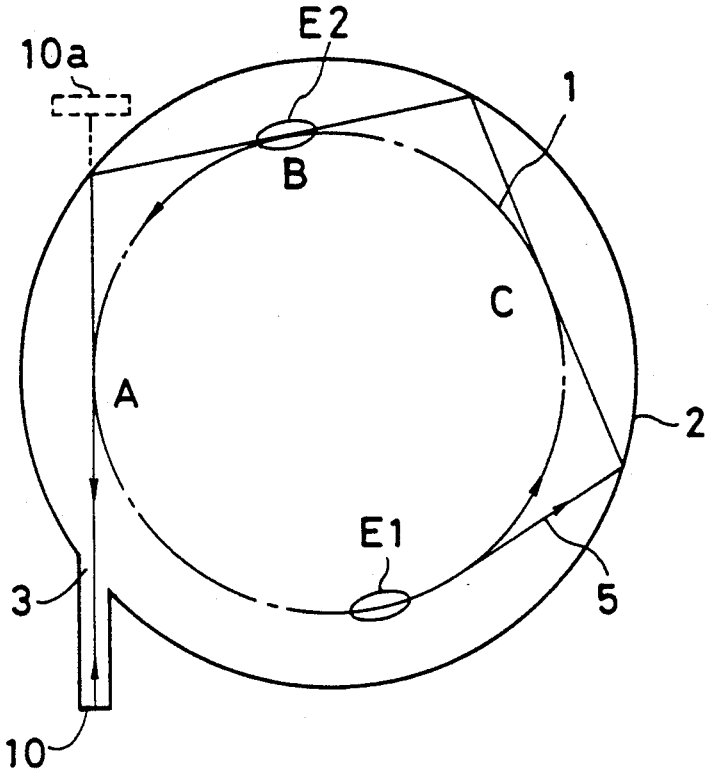
FIG. 1 is a schematic view showing a main portion of an inverse Compton scattering apparatus according to an embodiment of the present invention.

Referring to FIG. 1, the configuration of an inverse Compton scattering apparatus according to an embodiment of the present invention is shown schematically. An electron orbit 1 is circular, and for example, two bunches of electrons E1 and E2 run on the orbit. When charged particles move in a circular orbit, radiation is emitted in a tangential direction. A light guide 2 capable of reflecting light emitted from the electron orbit is concentrically provided in the outside of the electron orbit 1 and on a plane containing the electron orbit 1. The light guide 2 has an arcuate shape also in a direction perpendicular to the surface of the paper and has a function for reflecting light emitted form the electron orbit 1 in a tangential direction thereof to thereby turn the light in a tangential direction of the electron orbit again.

Electrons in the electron orbit 1 generate radiation as they perform circular motion. The radiation thus generated travels in a tangential direction of the electron orbit 1 and is reflected on the light guide 2 to form a tangent to the electron orbit again because of the nature of the concentric circle. Thus, the light is repeatedly reflected on the light guide 2. For example, radiation 5 emitted form the electron bunch E1 is repeatedly reflected on the light guide 2 so that the light comes into contact with the electron orbit 1 at points C, B and A. Because radiation is generated at all points on the electron orbit 1, such reflected light is present on the whole circumference. An aperture is provided to form a light pick-up port 3 at one point in the light guide. The SR light can be taken out from the light pick-up port. Because radiation travels in a tangential direction of the circular electron orbit, a direction of a tangent drawn from the light pick-up port 3 to the electron orbit 1 becomes a traveling direction of light.

In the configuration shown in the drawing, a reflection means 10 for reflecting light taken out from the light pick-up port 3 is provided to reflect the SR light in the reverse direction. Preferably, the reflection means 10 has a lens function for focusing the reflected light onto the electron orbit. To strengthen the re-introduced light, it is preferable that each of the light guide 2 and the reflection means 10 has a sufficiently high reflectivity to focus the reflected light onto the electron orbit again.

The radiation reflected by the reflection means 10 travels reversely on the light path and comes into contact with the electron orbit in a tangent direction thereof. At this time, Compton scattering is produced if an electron bunch is present on the electron orbit 1.

Figure 2:
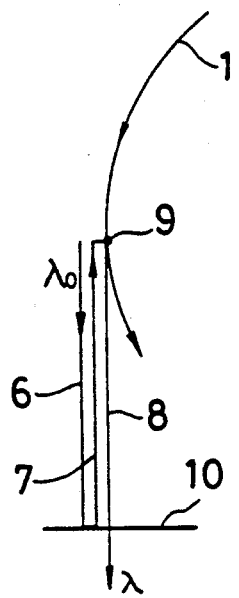
FIG. 2 is a conceptual view for explaining inverse Compton scattering produced in the configuration of FIG. 1.

FIG. 2 is a conceptual view for explaining Compton scattering produced in this way. Radiation 6 generated from the electron orbit 1 has a relatively long wavelength $\lambda 0$. The radiation 6 is reflected by the reflection means 10 and travels in the reverse direction. The reflected light 7 has the same wavelength $\lambda 0$. When the reflected light 7 collides with an electron 9 traveling on the electron orbit 1 in the direction of the arrow, the light 7 receives an energy from the electron 9 to form a short-wavelength $\lambda$ light 8 scattered in the traveling direction of the electron.

The inverse-Compton-scattered light has a wavelength distribution, and the shortest wavelength $\lambda$ of the light thus obtained is given by the following formula:

$$\lambda = \lambda 0/(4\gamma^2) \quad (1)$$

in which $\lambda 0$ represents the wavelength of incident light, and $\gamma$ represents the Lorentz polarization factor of a relativistic electron as shown in the special relativistic theory, that is, $\gamma$ is expressed by the formula:

$$\gamma = 1/(1-\beta^2)^{\frac{1}{2}} = E/0.511$$

(in which E represents electron energy expressed in MeV).

In the case where the electron energy is 500 MeV, light with the wavelength of the order of nm can be taken out if a millimeter wave is introduced as incident light. In this way, above, short-wavelength output light can be thus obtained.

Referring to FIG. 1, light reflected by the reflection means 10 but not scattered at the point A is reflected on the light guide 2 and then comes into contact with the electron orbit at the point B again. The probability of occurrence o scattering is increased by reflecting light on the light guide to make the reflected light repeatedly come into contact with the electron orbit.

In the following, parts of the inverse Compton scattering apparats shown in FIG. 1 are described in more detail.

Figure 3A:
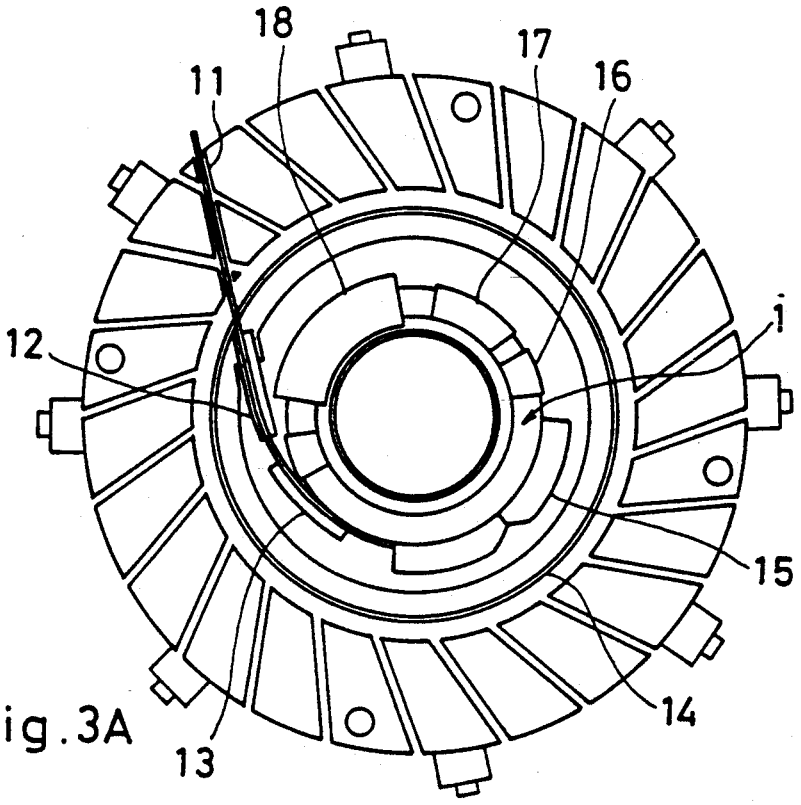
FIGS. 3A and 3B are a horizontal sectional view and a vertical sectional view of an SR apparatus suitable for realizing the inverse Compton scattering apparatus depicted in FIG. 1.
Figure 3B:
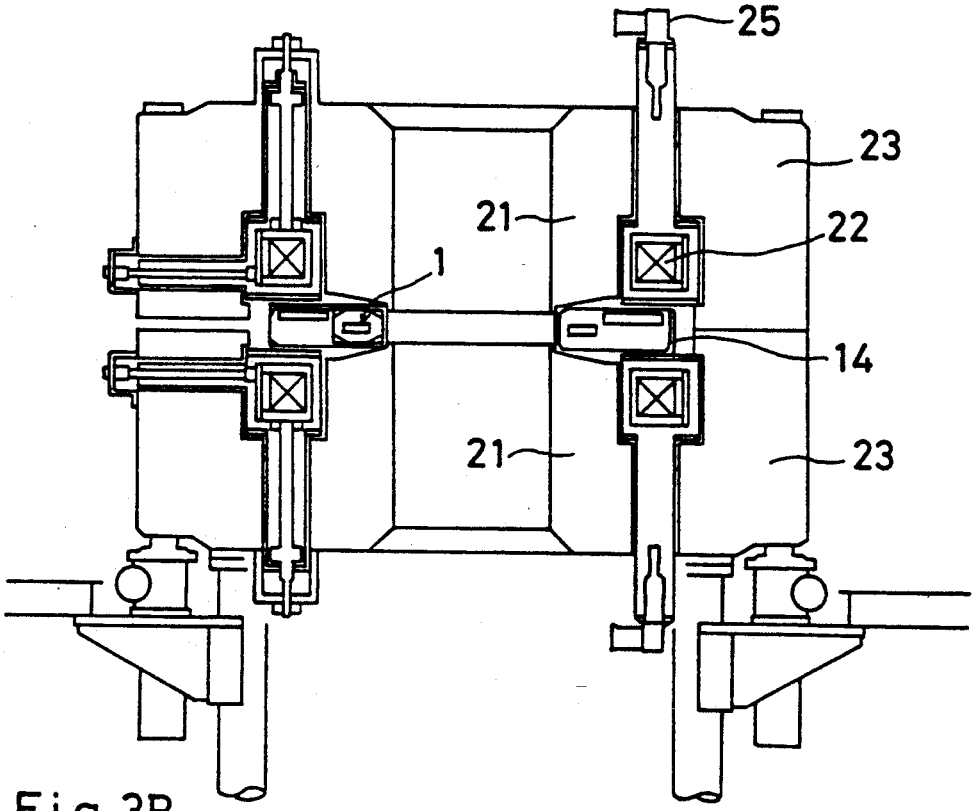

The circular electron orbit 1 is provided in the SR apparatus as shown in FIGS. 3A and 3B.

FIG. 3A is a sectional view showing the plan configuration of the SR apparatus, and FIG. 3B is a vertical sectional view of the same. In the drawings, electrons accelerated by a microtron or the like are introduced into a vacuum camber 14 from an incident duct 11, and the traveling direction of the electrons is adjusted by magnetic channels 12 and 13. An inflector 15 is means for adjusting the electron orbit by a voltage. A resonance jumper 16 is means for escaping a resonance state earlier to prevent the occurrence of a dispersing phenomenon due to resonance induced by beta vibration on the basis of the magnetic field change at the time of the accelerating of the electrons. A perturbator 17 serves to catch an incident beam to thereby introduce the beam onto the electron orbit 1 having a predetermined true circular shape. The introduced electrons are accelerated by an RF cavity 18 and stored in the true circular electron orbit. Magnets shown in FIG. 3B are disposed above and below the electron orbit to form a strong magnetic field in the vertical direction in the drawing. Superconducting coils 22 are arranged around the magnets 21 so that a strong magnetic field is produced in the magnets 21 by the supply of currents to the superconducting coils. The superconducting coils are refrigerated by a liquid helium refrigerator 25 to be kept in a superconducting state.

The superconducting magnet structure shown in FIG. 3B has a large gap in which a vacuum chamber 14 is disposed and an electron orbit is formed in the inside of the vacuum chamber. The magnets 21 are connected to each other by return yokes 23 provided in the outside of the magnets.

When charged particles with a velocity v are introduced into a uniform magnetic field B, the force of e(v*B) acts upon the charged particles so that the charged particles make a circular motion based on the force as centrifugal force. As a result, a perfectly circular electron orbit is formed. In FIG. 3A, the magnetic field is formed perpendicularly to the surface of the paper.

Common knowledge of the SR apparatus is described in Proc. of SPIE—The International Society for Optical Engineering, 923, (1988), p. 47, which is hereby incorporated by reference.

A light guide 2 as shown in FIG. 1 is formed in the outside of the electron orbit 1, and an SR apparatus having the Photon Storage Ring is formed.

The light guide 2 and the reflection means 10 are constituted by mirrors prepared through polishing, vacuum deposition, or the like, of a metal such as copper, gold, aluminum, or the like, having a sufficiently high reflectivity at wavelengths of interest, or by other optical parts having wavelength selectivity such as a grating, a dielectric multilayer film, an etalon, or the like. In the case where the reflection means 10 is constituted by an output light impermeable member such as a metallic mirror, the scattered light 8 is taken out as output light by providing a slit in the mirror. In the case where the reflection means 10 is formed of parts having wavelength selectivity, the scattered light 8 ma be taken out as output light by designing the permeability of the parts at wavelength $\lambda 2$ to a predetermined value. Also, in the case where SR light is taken out, a light take-out means is provided in the light guide.

Common knowledge of the light storage ring is described in Japanese Journal of Applied Physics, 28, (1989), pL1665, which is incorporated herein by reference.

Figure 4A:
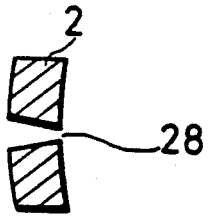
FIGS. 4A and 4B are a sectional view and a perspective view showing an example of the configuration of a light guide.
Figure 4B:
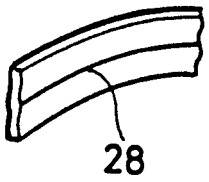

FIGS. 4A and 4B shown an example of the configuration of the light guide 2. For example, the light guide 2 is constituted by a metallic member having its inner surface polished to a mirror so that light is reflected on the inner surface. The light guide is disposed in the vacuum cell so as to enclose the outer circumference of the electron orbit. The curved surface of the light guide forms a circle concentric with the electron orbit in a plane containing the electron orbit, and, preferably, the radius of curvature of the light guide is set to a specific value which will be described later. In a direction perpendicular to the electron orbit plane, preferably, the light guide has a curved surface for focusing the reflected light onto the electron orbit again. The aforementioned light guide constitutes the Photon Storage Ring.

To take out radiation stored in the light storage rig, a slit is formed in the center portion of the light guide 2 so that radiation of interest can pass. Light is emitted from every point of the electron orbit 1 in a tangential direction thereof. The light once emitted is reflected on the light guide 2 so as to circulate within the light guide 2. At a place at which the circulating light is to be used, a light take-out port may be formed by replacing a mirror of the light guide by a light-permeable window. For example, a light take-out port 28 can be formed by providing a slit-like aperture or by providing a half mirror having a predetermined reflectivity for SR light of a predetermined wavelength and having a predetermined permeability for inverse Compton scattered light of a predetermined wavelength as shown in FIGS. 4A and 4B. A light pick-up port 3 for taking out light for producing inverse Compton scattering may be constituted of a larger aperture if necessary.

The inner surface of the light guide 2 has a large radius of curvature in a horizontal direction and has a small radius of curvature in a vertical direction. When far-infrared or millimeter wave is considered as re-introduced light, the reflectivity is little affected by a slit even if the slit provided in the light guide has a width of the order of mm or the slit provided in the light guide is constituted of a mesh. Furthermore, short-wavelength soft X rays have a property that they can pass through a sufficiently narrow slit because they are focused sharply forward. Further, to take out short-wavelength X rays ranging from the order of KeV to the order of tens of KeV, a thin film may be used in the slit portion. For example, a thin film may be formed of a Be film coated with gold and having a thickness of about 10 $\mu$m.

In the configuration of FIG. 1, the reflected light returned by the reflection means 10 makes inverse Compton scattering by touching the electron orbit 1 at points A, B, C. . . while reflected on the light guide 2. However, light not scattered circulates in the reverse direction in the light guide while reflected repeatedly. If the light not scattered reaches the light pick-up port 3, the light cannot be reflected so that a loss occurs.

Figure 5:
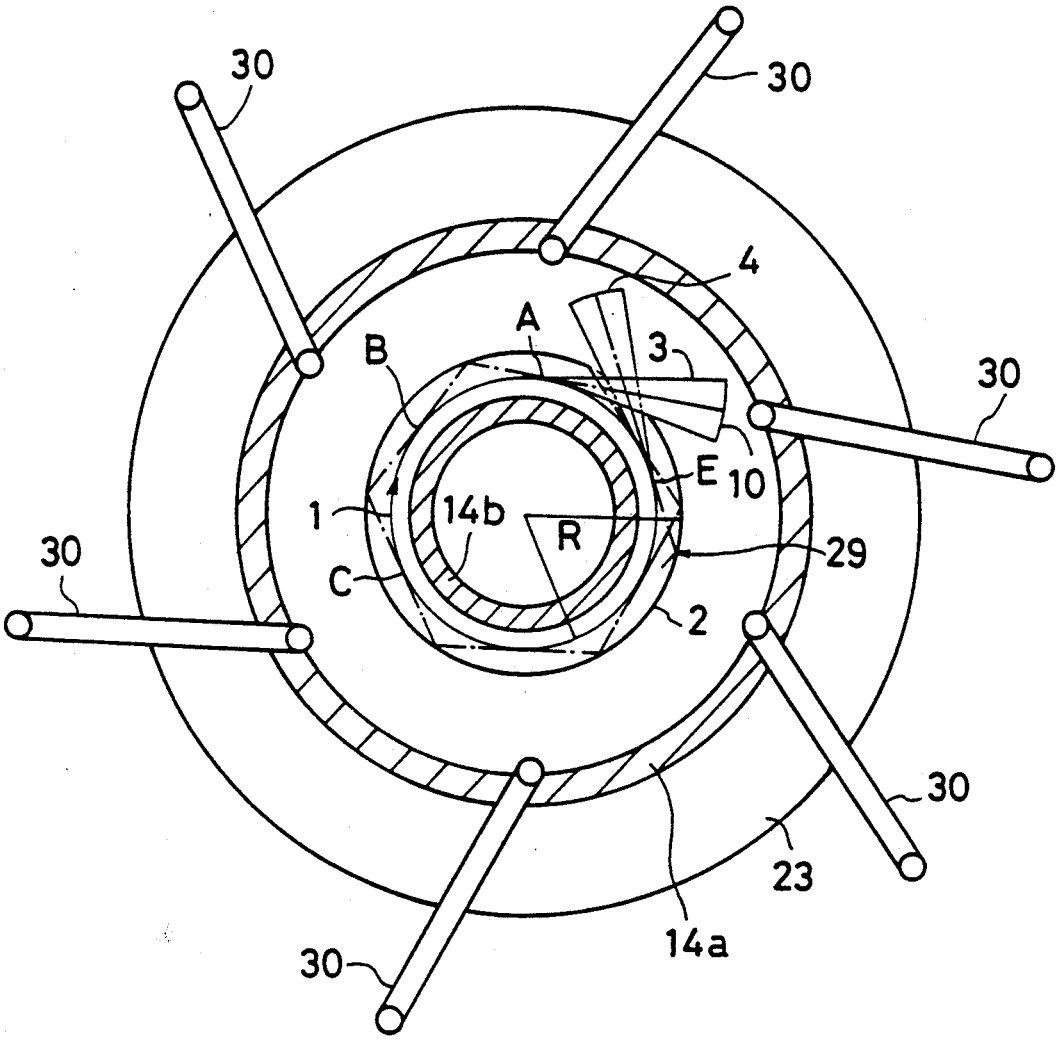
FIG. 5 is a schematic view showing an inverse Compton scattering apparatus having a reflector for introduced light.

FIG. 5 shows a configuration in which a reflector 4 for reflecting incident light circulating in the light guide is provided to attain reduction of the loss of incident light. SR light is stored in the light storage ring 29 constituted by a beam duct. Circulating SR light is taken out at the light takeout port 3. A long-wavelength component of radiation is reflected in the reverse direction on the reflector having a lens function and is introduced into the electron orbit substantially in a tangential direction thereof. The photons traveling in the reverse direction come into contact with the electron orbit 1 at points A, B, C. . . and collide with electrons traveling on the electron orbit to thereby produce inverse Compton scattering.

The re-introduced radiation is subjected to inverse compton scattering by the electrons and emitted sharply toward the light take-out port 3. The wavelength of the scattered light becomes short because the wavelength is shifted by the reception of energy form the electron. Light not subjected to scattering at the point A is reflected on the cylindrical light guide 2 and then travels in the light storage ring 29 in a direction reverse to the direction of the movement of the radiation light, so that the light collides with electrons at the points B, C,. . . again.

After reflected by predetermined number of times, the reintroduced radiation light enters into the reflector 4. The reflector 4 reflects the incident light to make the light travel in the reverse direction. The reflected light returns to the light take-out port 3 on the same light path and then reflected in the reflector 10 again. Thereafter, the same procedure is repeated. Radiation generated in the light guide structure as shown in FIG. 5 is enclosed in the light guide and permanently circulates to repeatedly collide with electrons. As a result, short-wavelength light can be generated very efficiently.

It is preferable to make the distance between the reflector 4 and the point E substantially equal to the distance between the reflector 10 and the point A.

As described above, the re-introduced radiation light is subjected to inverse Compton scattering efficiently so that the wavelength thereof is shortened.

Output light channels piercing the return yokes 23 are provided. Output light can be taken out at a desired point by forming a light take-out port means in the light guide 2.

Electrons in the electron orbit 1 circulate in the form of electron bunches. Therefore, the position where radiation is emitted from electrons is changed with the passage of time. Because the radiation is emitted in the form of a pulse signal having the circulating frequency of an electron beam, it is preferable to determine the timing for the collision of the reintroduced radiation with the circulating electrons at the point A.

With respect to the shape of the light guide, there are several approaches in order to maximize the probability of occurrence of scattering of the re-introduced light and the electrons. Referring to FIG. 5, the radius of curvature of the light guide in the electron orbit plane is preferably determined by the formula:

$$2q\rho\tan\theta/c-(2\pi/k-2q\theta)\rho/v=0 \quad (2)$$

in which $\rho$ represents the radius of the electron orbit, $\theta$ represents an angle of the movement of the introduced light from a point where it collides with an electron to a point where it reaches the reflection surface of the light guide 2, q represents the number of times of reflections before the introduced light collides with an electron again, k represents the number of bunches, c represents the light velocity, and v represents the electron velocity in the orbit direction and being substantially equal to c. The radius of curvature of the light guide is expressed by the following formula $$R=\rho/\cos\theta$$

When q and $\rho$ are 3 and 0.5 m, respectively, the introduced light repeatedly collides with the electrons, if R is about 0.5429. Similarly when q and $\rho$ are 4 and 0.5 m, respectively, the introduced light also repeatedly collides with the electrons if R is about 0.5024.

Light diverged in the vertical direction can be preferably focused onto the electron beam orbit again if the curved surface of the light guide in the vertical direction has a radius of curvature expressed by the following formula.

$$Rv=\rho\tan\theta*\sin\theta$$

If the distance between the reflection means 10 and the contact point A is integral multiples of $\pi\rho/2$, the next bunch reaches the point A to produce scattering of the introduced light when light emitted form the point A is reflected by the reflection means 10 and then reaches the point A again.

In the following, the material and shape of each of the cylindrical light guide 2 and the reflectors 4 and 10 will be described. The material must have a high reflectivity for light having wavelengths of interest. The reflectivity varies depending on the wavelength of light to be reflected. If the light is a millimeter wave, a large reflectivity can be obtained easily by most of metals. If the wavelength of the light is shorter than far infrared and longer than visible light, deposition of a metal or metals such as copper, gold, etc., dielectric multilayer film and the like can be effectively used. The condition for the configuration also varies depending on the wavelengths of interest. If the light is a millimeter wave, a large reflectivity can be obtained easily by a metallic mesh. To take out short-wavelength light from the light storage ring, it is preferable that a hole or slit 10 is formed in each of the reflectors and the light guide.

Although, in the aforementioned embodiment, the long-wavelength component of radiation is used as an introduced light source, the present invention can e applied to the case where a high-frequency oscillator or a laser is additionally provided.

Figure 6:
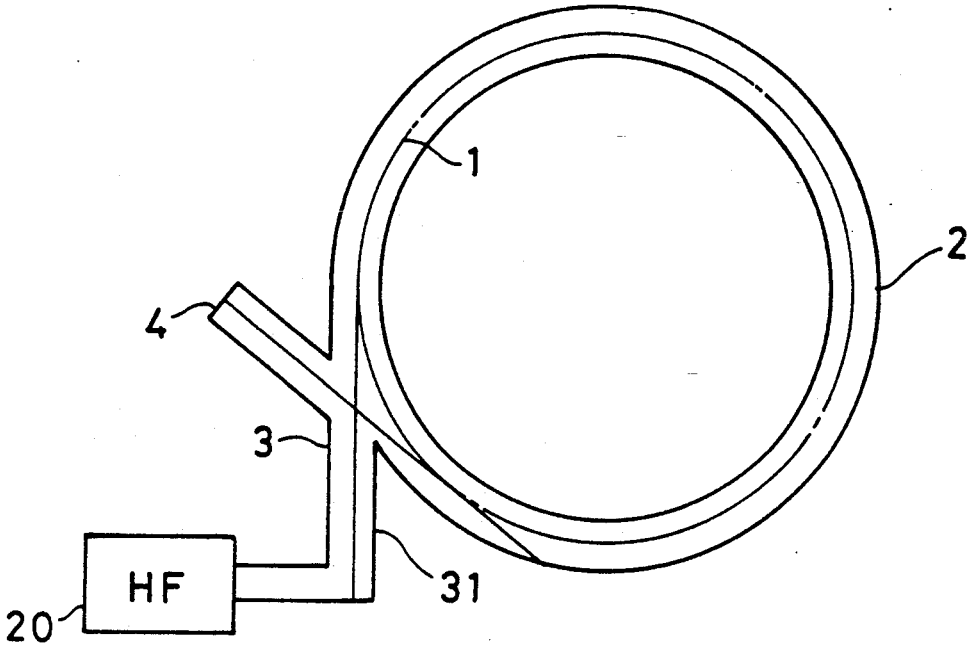
FIG. 6 is a schematic view of an inverse Compton scattering apparatus having a high-frequency oscillator as an introduction light source.
Figure 7:
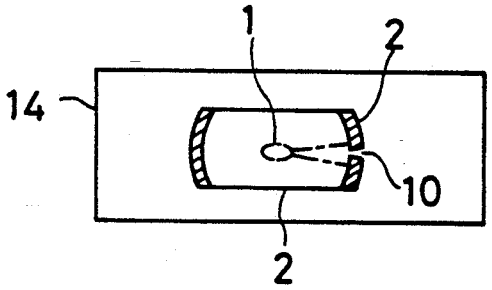
FIG. 7 is a sectional view showing a waveguide structure of the inverse Compton scattering apparatus depicted in FIG. 6.

FIG. 6 shows the case where a high-frequency oscillator 20 is used. For example, the high-frequency oscillator 20 generates a high-frequency electromagnetic wave of 3 GHz or 10 GHz and supplies it to the electron orbit 1 through a waveguide 31. The curvature of the cylindrical light guide 2 and the position of the reflection means 4 are the same as those in FIG. 5. However, in the case where a microwave is used, each of the waveguide path 31 and the light guide 2 can be constituted of a waveguide. Accordingly, the cylindrical light guide 2 can be replaced by a waveguide having a section as shown in FIG. 7 and surrounding the electron orbit. It is preferable that a slit 10 for taking out short-wavelength light is provided in a side wall of the waveguide. The slit or aperture is necessary for introducing high-energy electrons into the electron storage ring having a truly circular electron orbit.

The high-frequency oscillator may be replaced by a laser. In this case, laser light travels straight. Accordingly, it is preferable that the light incident surface and the light out-coming surface are formed on one and the same plane in the same manner as in FIG. 1.

Figure 8:
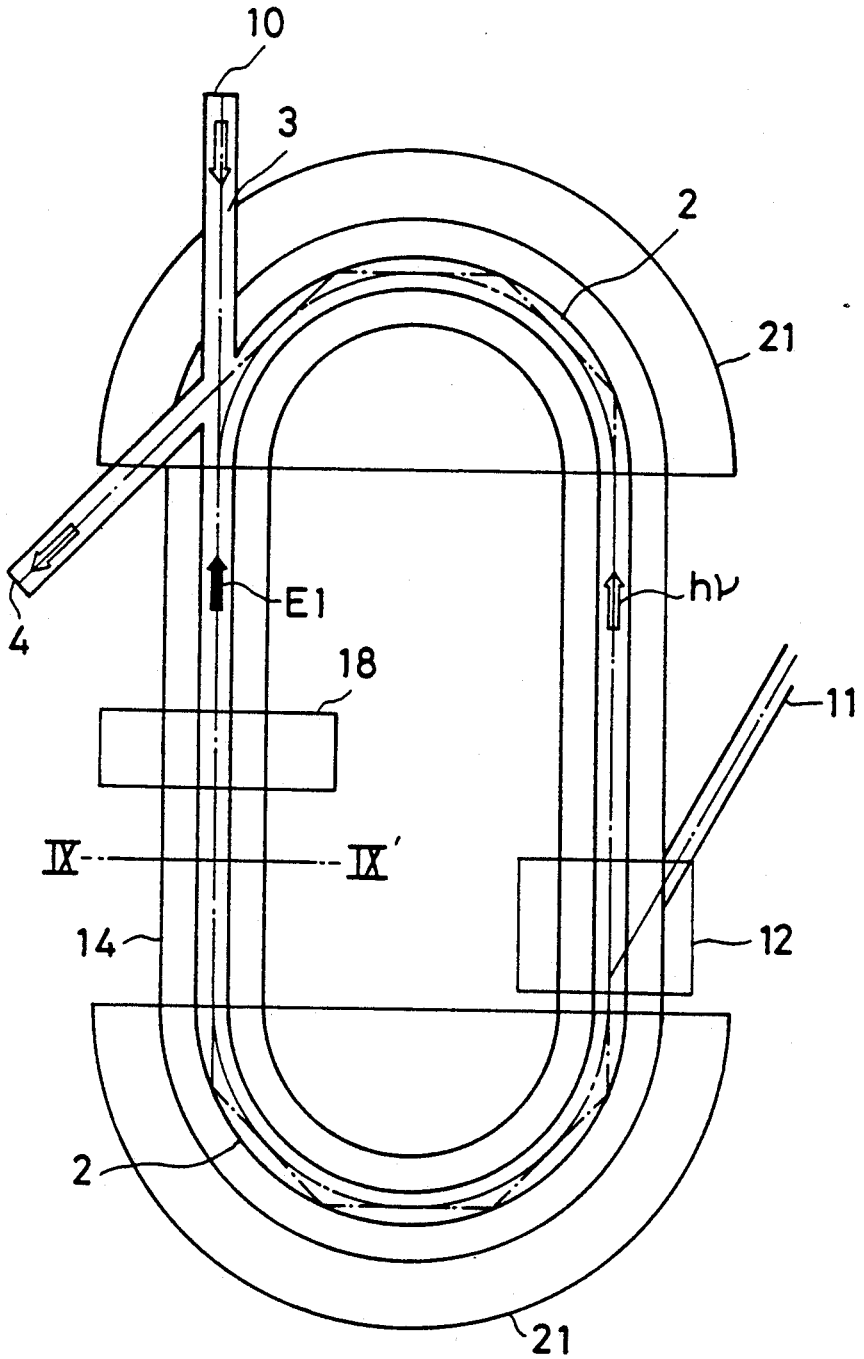
FIG. 8 is a schematic view of an inverse Compton scattering apparatus having a race track type electron orbit.

FIG. 8 shows the configuration of the short-wavelength light generating light storage ring having a non-circular electron orbit having a straight portion. Electrons introduced from an electron input duct 11 are caught by an incident means 12 and stored in the electron orbit. The electron bunch E1 travels in the direction of the arrow. Other electron bunches are not shown in the drawing. The electron bunch is accelerated by the RF cavity 18 and circulates in the race track orbit. SR light is emitted in the same direction as that of the electron bunch. Light taken out at the light take-out port 3 is reflected by the reflection means 10 and then travels in the reverse direction. Light reflected on the light guide and circulating is reflected on the reflector 4 and then reflected by the reflecting means 10 of the light take-out port means 3, so that the light travels in the direction reverse to that of the electrons again.

Figure 9:
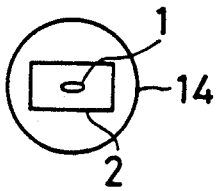
FIG. 9 is a sectional view taken along the line IX–IX' of the light storage ring in the configuration of FIG. 8.

FIG. 9 is a sectional view taken along the line IX–IX', of the vacuum chamber 14 depicted in FIG. 8. A light guide 2 shaped like a rectangular waveguide is provided in the vacuum chamber 14.

Figure 10:
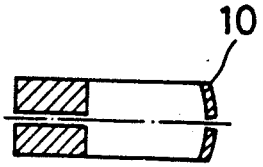
FIG. 10 is a sectional view of a reflector for returning light emitted from the electron storage ring to the electron orbit.

FIG. 10 is a sectional view showing an example of the construction of a part of the reflector 10. The concave-mirror-shaped reflector 10 reflects SR light to direct the reflected light tot he electron obit. In the configuration of FIG. 8, a light orbit and an electron orbit may be overlapped to some degree on the straight portion.

In this case, the introduced long-wavelength electromagnetic wave should circulate in the light guide. Therefore, firstly, in the formula (3) in the 180 degrees deflection magnets 21 must take a such value as $\pi/4$ or $\pi/6$ obtained by dividing $\pi/2$ by an integer. Thereby, the introduced light translates in the straight line portion in the drawing. When $\theta$ is determined, the distance between bunches is determined. That is, the distance L between bunches is determined according to the following formula $$2q\rho\tan\theta/c\text{-}(L-2q\theta\rho)/v=\theta \quad (3).$$

Thereby, the circulating frequency of electrons is uniquely determined and the circumference length of the electron orbit must be an integral multiple of L. The aforementioned configuration can be provided by adjusting the length of the straight line portion.

A Fabry-Perot type configuration may be provided by removing the light guide 2 from the configuration of FIG. 1 and arranging another reflection means 10*a* in opposition to the reflection means 10 as shown by the broken line. Light reflected at the point A is reflected by the reflection means 10, passed through the point A and reflected by the opposite reflection means 10*a*, so that the light is directed through the point A toward the reflection means 10 again. Light newly emitted from the electron orbit 1 is also superimposed. The respective positions of the reflections means 10 and 10*a* are preferably selected to make the light reflected by the reflection means 10 collide with the electron bunch at the point A.

Although the present invention has been described in conjunction with the preferred embodiments, the present invention is not limited thereto. It will be obvious for those skilled in the art that various replacements, alterations, changes, combinations and the like can be made within the scope and spirit of the appended claims.

I claim:

1. An inverse Compton scattering apparatus comprising:

means for storing relativistic electrons in a closed loop, at least a portion of said loop being curved;

means for injecting long-wavelength light in a direction opposite to the direction of movement of said electrons and along a tangential direction of the curved portion of said loop to thereby produce a collision between the light and said electrons at said curved portion of the loop, wherein said light injecting means includes a reflection means for reflecting radiation emitted from the electron loop;

means for taking out short-wavelength light inverse-Compton-scattered by said collision; and a light guide surrounding the electron loop for reflecting radiation coming from the electron loop.

2. An inverse Compton scattering apparatus according to claim 1, in which said means for injecting long-wavelength light includes a laser device or a high-frequency device.

3. An inverse Compton scattering apparatus according to claim 1, in which: said electron storage ring stores electrons circulating in the form of a bunch or bunches so that radiation therefrom becomes a pulse light having a specific period; said reflection means is positioned so that reflected radiation collides with the electrons in synchronism with the bunch of circulating electrons; and said light guide has a radius of curvature selected to reflect the reflected radiation thereon to thereby make the radiation repeatedly collide with the electrons.

4. An inverse Compton scattering apparatus according to claim 1, in which said reflection means has such a radius of curvature to focus the reflected light onto the electron loop.

5. An inverse Compton scattering apparatus according to claim 1, in which said electron loop has a straight line portion, and in which the length of the straight line portion of said electron loop, the radius of curvature at an electron deflection portion, the number of harmonics and the circulating frequency of the circulating electrons, and the radius of curvature of the light guide for storing light are so selected as to make the introduced light collide with electrons efficiently and repeatedly.

6. An inverse Compton scattering apparatus according to claim 1, in which said means for taking out short-wavelength light is one selected from the group consisting of a slit, a mesh and a film having a matrix material and a thickness enabling the short-wavelength light to pass.

7. An inverse Compton scattering apparatus according to claim 1, wherein said light guide comprises means for taking out short-wavelength light.

8. An inverse Compton scattering apparatus according t claim 1, wherein said light guide comprises means for taking out short-wavelength light.

9. An inverse Compton scattering apparatus according to claim 3, wherein said light guide comprises means for taking out short-wavelength light.

10. An inverse Compton scattering apparatus according to claim 4, wherein said light guide comprises means for taking out short-wavelength light.

11. An inverse Compton scattering apparatus according to claim 5, wherein said light guide comprises means for taking out short-wavelength light.

12. An inverse Compton scattering apparatus according to claim 6, wherein said light guide comprises means for taking out short-wavelength light.

13. The inverse Compton scattering apparatus of claim 1, wherein said closed loop is a perfectly circular orbit.

14. The inverse Compton scattering apparatus of claim 1, wherein said closed loop is a perfectly circular orbit.

15. The inverse Compton scattering apparatus of claim 3, wherein said closed loop is a perfectly circular orbit.

16. The inverse Compton scattering apparatus of claim 4, wherein said closed loop is a perfectly circular orbit.

17. The inverse Compton scattering apparatus of claim 6, wherein said closed loop is a perfectly circular orbit.

18. The inverse Compton scattering apparatus of claim 7, wherein said closed loop is a perfectly circular orbit.

* * * * *

UNITED STATES PATENT AND TRADEMARK OFFICE

CERTIFICATE OF CORRECTION

PATENT NO. :5,227,733

DATED :July 13, 1993

INVENTOR(S) :YAMADA, Hironari

It is certified that error appears in the above-identified patent and that said Letters Patent is hereby corrected as shown below:

Title page, Section [56] References Cited,
Under "U.S. PATENT DOCUMENTS"

Insert, --3,886,366 5/1975 Kash--.

Signed and Sealed this

Twenty-fourth Day of October, 1995

*Attest:*

*Attesting Officer*

Bruce Lehman

BRUCE LEHMAN

*Commissioner of Patents and Trademarks*